US009261090B2

(12) United States Patent
Haeberer

(10) Patent No.: US 9,261,090 B2
(45) Date of Patent: Feb. 16, 2016

(54) DIAPHRAGM PUMP, AND EXHAUST-GAS AFTERTREATMENT SYSTEM HAVING A DIAPHRAGM PUMP

(75) Inventor: Rainer Haeberer, Bretten (DE)

(73) Assignee: Robert Bosch GmbH, Stuttgart (DE)

( * ) Notice: Subject to any disclaimer, the term of this patent is extended or adjusted under 35 U.S.C. 154(b) by 279 days.

(21) Appl. No.: 13/982,942

(22) PCT Filed: Dec. 30, 2011

(86) PCT No.: PCT/EP2011/074323

§ 371 (c)(1),
(2), (4) Date: Jul. 31, 2013

(87) PCT Pub. No.: WO2012/104001

PCT Pub. Date: Aug. 9, 2012

(65) Prior Publication Data

US 2013/0309108 A1 Nov. 21, 2013

(30) Foreign Application Priority Data

Feb. 1, 2011 (DE) ..... 10 2011 003 461

(51) Int. Cl.
*F04B 43/04* (2006.01)
*F04B 17/04* (2006.01)

(52) U.S. Cl.
CPC ..... *F04B 43/04* (2013.01); *F04B 17/04* (2013.01)

(58) Field of Classification Search
CPC ..... F04B 45/04; F04B 45/047; F04B 43/04; F04B 43/043; F04B 43/02; F04B 17/04; F04B 17/042; F04B 35/015; F04B 43/028; F04B 35/04; F04B 45/045
USPC ..... 417/413.1, 413.2, 395, 559, 569, 571
See application file for complete search history.

(56) References Cited

U.S. PATENT DOCUMENTS 4,070,008 A * 1/1978 Schlieckmann ..... B29B 7/7615 366/159.1
4,406,591 A * 9/1983 Louis ..... F04B 45/027 417/363

(Continued)

FOREIGN PATENT DOCUMENTS

CN 1711419 12/2005
DE 102004011123 3/2005

(Continued)

OTHER PUBLICATIONS

DE 102008054686 A1—English Translation.*

(Continued)

*Primary Examiner* — Justin Jonaitis
*Assistant Examiner* — Christopher Brunjes
(74) *Attorney, Agent, or Firm* — Michael Best & Friedrich LLP

(57) ABSTRACT

Diaphragm pump for delivering a fluid, in particular an exhaust-gas aftertreatment medium, such as an aqueous urea solution for example, comprising a working chamber (1) which is delimited by a working diaphragm (2) and which can be connected via a first valve (3) to an inlet (4) and via a second valve (5) to an outlet (6), and an electromagnet (7) which comprises a coil assembly (8) and an armature (9) which interacts with the coil assembly (8) and is operatively connected to the working diaphragm (2). According to the invention, the valves (3, 5) are configured in a valve plate (10) which is arranged between the coil assembly (8) and the armature (9). Exhaust-gas aftertreatment system having a diaphragm pump of this type.

20 Claims, 6 Drawing Sheets

(56) References Cited

U.S. PATENT DOCUMENTS

| | | | | |
|---|---|---|---|---|
| 4,585,030 | A * | 4/1986 | Fox | G05D 16/2093 137/625.61 |
| 5,607,292 | A * | 3/1997 | Rao | F04B 17/044 417/410.1 |
| 2009/0053074 | A1* | 2/2009 | Babicki | F04B 23/106 417/44.9 |
| 2010/0215522 | A1 | 8/2010 | Kawamura et al. | |
| 2012/0186714 | A1* | 7/2012 | Richardson | B60C 23/12 152/419 |

FOREIGN PATENT DOCUMENTS

| | | | | |
|---|---|---|---|---|
| DE | 102005003583 | | 7/2006 | |
| DE | 102008043309 | | 5/2010 | |
| DE | 102008054686 | | 6/2010 | |
| DE | 102008054686 | A1 * | 6/2010 | F01N 3/208 |
| JP | S422918 | | 2/1967 | |
| JP | 54-31364 | | 1/1979 | |
| JP | H01247777 | | 10/1989 | |
| JP | 10-184553 | | 7/1998 | |
| JP | 2002106467 | | 4/2002 | |
| JP | 2009185736 | | 8/2009 | |
| JP | 2010223218 | | 10/2010 | |

OTHER PUBLICATIONS

International Search Report for Application No. PCT/EP2011/074323 dated May 8, 2012 (2 pages).

* cited by examiner

DIAPHRAGM PUMP, AND EXHAUST-GAS AFTERTREATMENT SYSTEM HAVING A DIAPHRAGM PUMP

BACKGROUND OF THE INVENTION

The invention relates to a diaphragm pump for delivering a fluid, in particular an exhaust-gas aftertreatment medium, such as, for example, an aqueous urea solution. In addition, the invention relates to an exhaust-gas aftertreatment system comprising such a diaphragm pump.

Diaphragm pumps, in particular diaphragm pumps that can be used in exhaust-gas aftertreatment systems, have already been disclosed by the prior art. The German patent application DE 10 2008 043 309 A1 discloses a diaphragm pump having a multi-parted pump housing, the working membrane of which is clamped between two housing parts and can be axially actuated by an electric motor via an eccentric and connecting rod. In order to fix the working diaphragm, the housing parts are axially clamped to one another.

A further diaphragm pump is disclosed by the published German patent application DE 10 2005 003 583 A1. In this case, the working diaphragm is not actuated via an eccentric connecting rod but rather by a piston, which is operatively connected to an armature of an electromagnet. When current is supplied to the coil assembly of the electromagnet, the armature is pulled in the direction of the coil assembly, wherein the working diaphragm is impinged with a compressive force via the piston connected to the armature. The compressive force causes the membrane to expand into the pump working chamber, i.e. a compression of the medium situated therein, said medium being subsequently discharged via a discharge valve. If current is no longer being supplied to the coil assembly, a spring supported on the armature ensures that armature and piston are restored to their initial positions. The working diaphragm contracts and creates a vacuum in the pump working chamber; thus enabling the intake of fresh medium. In order to impinge the working diaphragm with a compressive force, the piston is guided through the coil assembly. This requires small dimensional and bearing tolerances to be maintained during the manufacture of the piston and/or the armature. In addition, the guide area of the piston and/or the armature is subjected to an increased amount of wear due to friction. On account of the length of the piston, said piston can furthermore tilt, whereby the frictional forces and consequently the wear increase.

The German patent application DE 10 2004 011 123 A1 discloses a further diaphragm pump having a lifting solenoid as a drive, in which diaphragm pump the working diaphragm is directly connected to an armature of the solenoid that is embodied as a hollow cylinder. A piston for actuating the working membrane can thus be eliminated. The armature is accommodated in a sleeve-shaped sliding bearing. The lifting motion of the armature is delimited by the housing of the electromagnet, which can lead to an undesirable noise generation when the armature strikes the housing.

The German patent application DE 10 2008 054 686 A1 discloses a diaphragm pump comprising an electromagnet for actuating the working diaphragm, in which pump an elastic element embodies both a flat armature that interacts with the electromagnet and a return spring. In order to connect to the working membrane, the elastic element is encapsulated by the plastic of the working diaphragm. A radial guidance of the armature is therefore not necessary, whereby the wear in the region of the moving components is reduced. Due to the design of the flat armature, a compact arrangement is moreover created which only requires a small installation space.

SUMMARY OF THE INVENTION

Based on the prior art specified above, the aim of the invention is to provide a compact diaphragm pump which operates with low noise and low friction, can be actuated via an electromagnet and furthermore has a high degree of efficiency.

The aim is met by a diaphragm pump having the features of the claim 1. Advantageous modifications to the invention are specified in the dependent claims.

The proposed diaphragm pump for delivering a fluid, in particular an exhaust-gas aftertreatment medium, such as, for example, an aqueous urea solution, comprises a working chamber which is delimited by a working diaphragm and which can be connected via a first valve to an inlet and via a second valve to an outlet. Said diaphragm pump further comprises an electromagnet which includes a coil assembly and an armature which interacts with the coil assembly and is operatively connected to the working diaphragm. According to the invention, the valves are configured in a valve plate which is arranged between the coil assembly and the armature. Together with the working diaphragm, the valve plate preferably delimits the working chamber; thus enabling the arrangement of these pump components to take place between the coil assembly and the armature. The essential elements of the pump are thereby integrated into the electromagnet. In this way, a very compact pump arrangement is produced, which moreover—due to the separation of armature and coil assembly—can be operated with low noise and friction. The lack of a radial guidance of the armature furthermore results in reduced wear. The operative connection of the armature to the working diaphragm ensures a direct transmission of force and thus a high degree of efficiency of the pump. In a preferable manner, the armature is operatively connected to the working diaphragm by a frictional and/or form-fit, for example via a screw connection. Provision can alternatively be made for a clamping or latching connection. The ends of the working diaphragm are further fixed to the valve plate. A ring which engages in a corresponding receiving groove on the valve plate can, for example, be used to fix said ends to the valve plate.

According to one preferred embodiment of the invention, the valve plate is at least partially embedded in a housing of the electromagnet or in the armature. In so doing, an even more compact construction can be created. In addition, the embedded valve plate is likewise fixed in position.

According to one modification, the valve plate and/or the working diaphragm comprise damping grooves which are preferably disposed along the circumference. In the case of a circular layout of the working chamber, the damping grooves are preferably arranged in circles that are concentric to one another. The damping grooves dampen the movement of the armature because in order to build up pressure in the working chamber, the medium has to be displaced from the damping grooves.

It is furthermore proposed that the valve plate be at least partially covered on one or both sides by at least one additional plate which preferably consists of a non-magnetic material. The valve plate and the at least one additional plate together form a valve head, wherein the individual plates are preferably connected to one another by means of laser welding. The embodiment of the at least one additional plate from a non-magnetic material prevents a magnetic bonding of the armature to the magnet housing if the current supply to the coil assembly has ended. The at least one plate is preferably welded to the housing of the electromagnet.

The armature which is disposed separately from the coil assembly is advantageously guided in the radial direction by means of at least one spring. The spring assists in restoring the armature to the original position thereof after the current supply to the coil assembly has ended. The spring can, for example, be embodied as a helical compression spring and be supported on the one hand on the additional plate that at least partially covers the valve plate as well as on the other hand on the armature. In order to ensure a radial guidance of the armature, the spring preferably engages in a circumferential groove of the armature. If the restoring of the armature to its original position takes place via a plurality of springs, which are evenly disposed over the circumference of the armature, said springs preferably project in each case into a cup-shaped recess of the armature. When a plurality of springs is disposed over the circumference of the armature, the number of said springs has to be at least three, preferably four or more. The multiple springs are preferably spaced apart from one another at a uniform angular distance. In order to radially fix the position of the springs on the valve plate or the additional plate, a raised portion, for example in the form of a pin, is configured on the respective plate, around which the end of the spring is laid. A sufficient guidance of the spring or springs is also ensured by means of the guidance of the same on both sides. In order to achieve a damping of the movement of the armature, the spring or springs can also be designed as a progressive spring.

Furthermore, the armature preferably embodies a cup-shaped receiving space for the at least partial accommodation of the valve plate and/or a spring. A centrally arranged cup-shaped receiving space can, for example, serve to receive the valve plate. By means of a corresponding design of the armature plate, the working diaphragm is additionally supported during the build-up of pressure in the working chamber, which favorably affects the service life of the working diaphragm. Further cup-shaped receiving spaces can alternatively or additionally be disposed over the circumference, which serve at least partially to receive the return springs.

The cup-shaped receiving spaces can be worked into a flat armature plate by means of a shaping process. The armature is preferably a stamped/bent part which can be easily and cost effectively manufactured.

It is furthermore proposed that the electromagnet is a DC solenoid. Provision can alternatively or additionally be made for the electromagnet to comprise a coil having two inside diameters. In so doing, the highest possible number of windings can be achieved.

On the basis of the advantages of an inventive diaphragm pump specified above, such a pump is particularly suited for use in an exhaust-gas aftertreatment system for delivering an exhaust gas aftertreatment medium, in particular an aqueous urea solution. The diaphragm pump thus prevents the electromagnet from coming in contact with the medium to be delivered; thus enabling said electromagnet to be protected from corrosion. In addition, an exhaust-gas aftertreatment system comprising an inventive diaphragm pump for delivering an exhaust-gas aftertreatment medium, in particular an aqueous urea solution, is therefore proposed. Besides the previously specified advantage, the operation of the pump with low noise and low friction and the compact construction advantageously affect the exhaust-gas aftertreatment system.

BRIEF DESCRIPTION OF THE DRAWINGS

Preferred embodiments of the invention are explained below in detail with the aid of the attached drawings. In the drawings.

DETAILED DESCRIPTION

Figure 1:
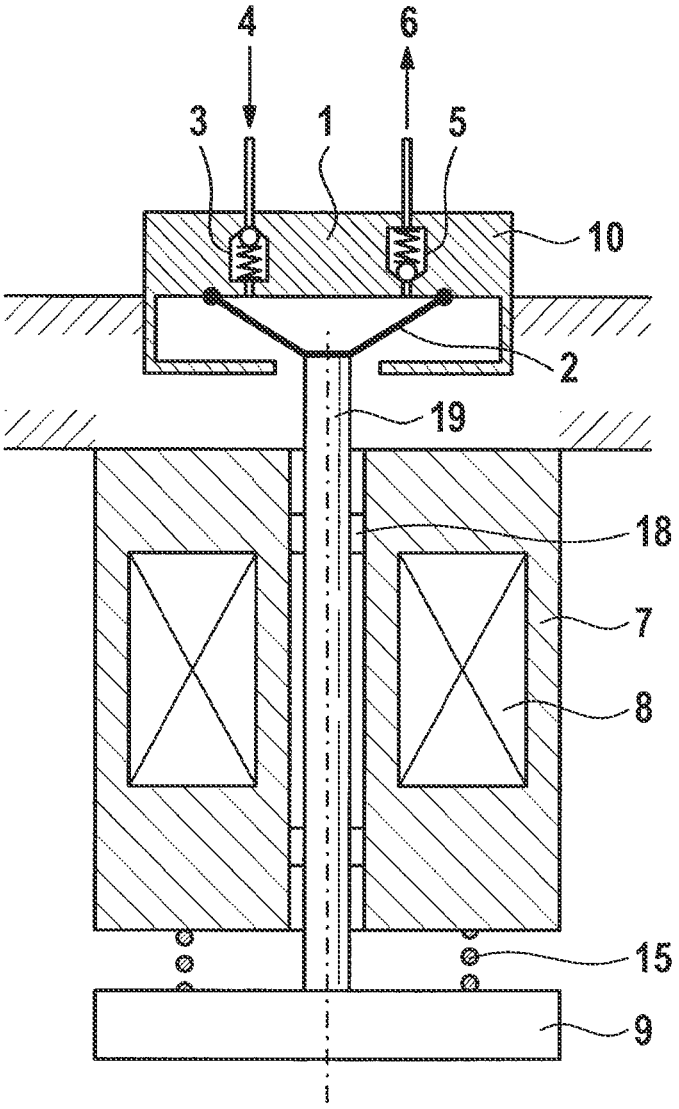
FIG. 1 Prior Art
FIG. 1 shows a schematic cross-section through a diaphragm pump known from the prior art.

The disadvantages of a known diaphragm pump from the prior art will now once again be made clear with the aid of the schematic cross-section through such a pump. The pump depicted has a working chamber 1 which is delimited from a working diaphragm 2 as well as from a valve plate 10. The valve plate 10 accommodates a first valve for connecting the working chamber 1 to an inlet 4 as well as a second valve 5 for connecting the working chamber 1 to an outlet 6. The valve plate 10 is mounted on a plate-shaped supporting element which supports an electromagnet 7 as the drive of the pump on the side facing away from the valve plate 10. The electromagnet comprises a coil assembly 8 as well as an armature 9 which interacts with the coil assembly 8 and is disposed on the side of the electromagnet 7 facing away from the valve plate 10. The armature 9 comprises an armature pin 19 which is passed through the coil assembly 8 and mounted in an axially displaceable manner via guides 18. When current is supplied to the coil assembly 8 of the electromagnet 7, the armature 9 is drawn in the direction of said coil assembly 8 and the armature pin 19 is carried along. The armature pin 19 thereby impinges the working diaphragm 2 with a compressive force which leads to a reduction in volume of the working chamber 1 and thereby to an increase in pressure; thus enabling the valve 5 to open and the medium that is present in the working chamber 1 to flow out via the outlet 6. If the current supply to the coil assembly 8 has ended, the spring force of a spring 15 supported on the armature 9 causes said armature 9 to be restored to its original position, the armature pin 19 also being reset. The resetting of the armature pin 19 makes an increase in volume of the working chamber 1 possible, which increase causes a vacuum in the working chamber 1. This causes fresh medium to be drawn into the working chamber 1 via the inlet 4 and the valve 3. The constructional length of the armature pin 19 has been proven to be a disadvantage because said pin can easily tilt when executing the axial movement. In addition, the contact surfaces in the region of the guides 18 undergo an increase in wear due to friction, which reduces the service life of the pump. Furthermore, the armature 9 strikes against the electromagnet 7 when the coil assembly 8 is supplied with current and the armature is moved in the direction of said coil assembly 8. This leads to a noise generation which is very undesirable.

The disadvantages described above are remedied or at least significantly reduced by the embodiments of inventive diaphragm pumps depicted in the succeeding figures.

Figure 3:
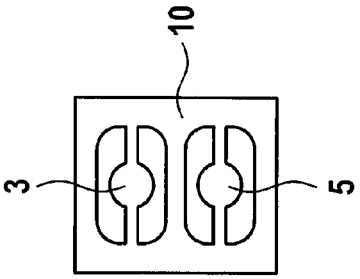
FIG. 3 shows a top view of a valve assembly.
Figure 2:
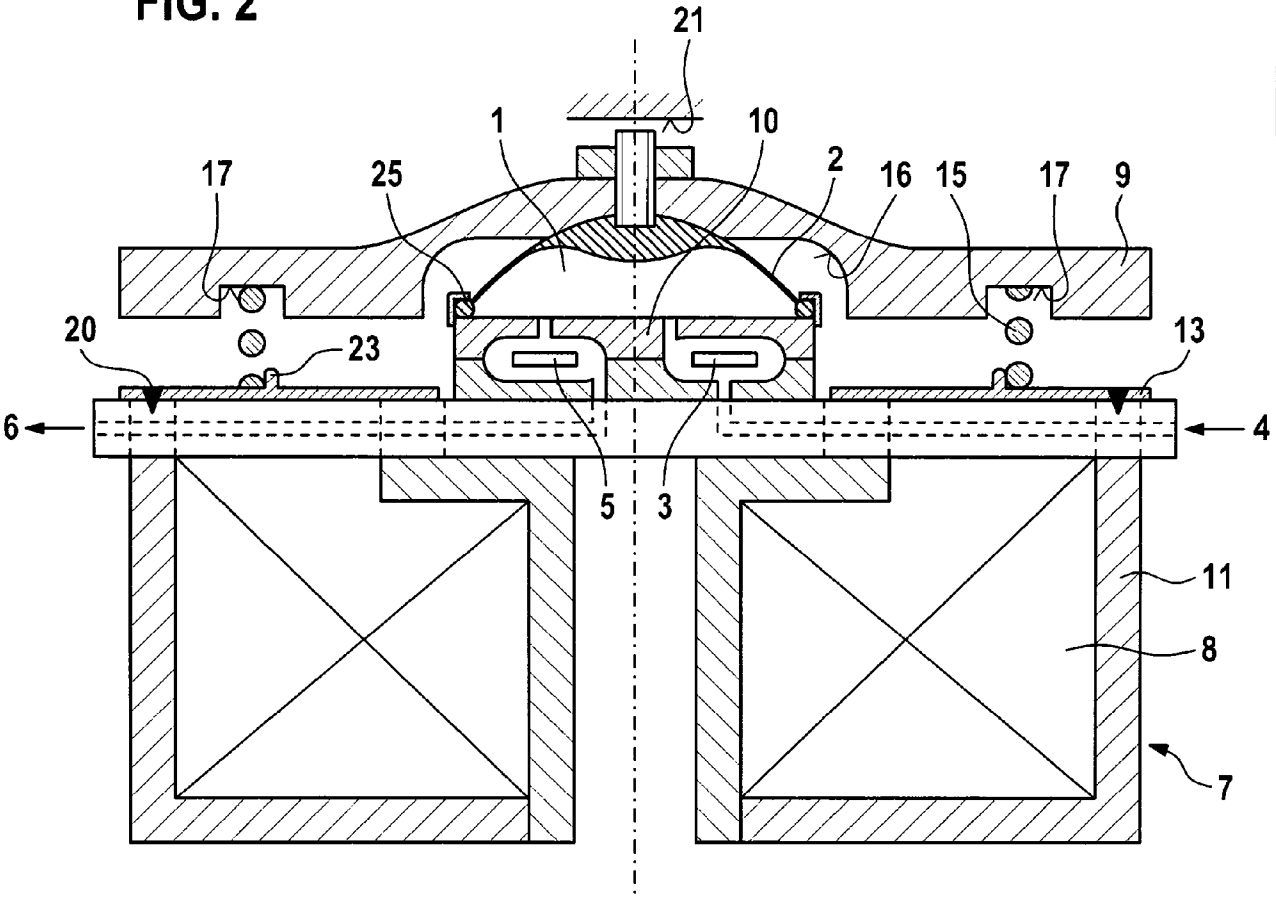
FIG. 2 shows a schematic cross-section through a diaphragm pump according to the invention.

A first embodiment of a diaphragm pump according to the invention is depicted in FIG. 2. The drive takes place via an electromagnet 7 which comprises a coil assembly 8 as well as an armature 9. The coil assembly 8 is accommodated in a housing 11, which is closed by a valve plate 10 in the direction of the armature 9. The valve plate 10 accommodates a first valve 3 which is connected to an inlet 4 as well as a second valve 5 which is connected to an outlet 6, wherein the two valves 3, 5 (see FIG. 3) as well as the inlet 4 and the outlet 6 are in each case disposed in a common radial plane. In the present embodiment, the valve plate 10 is composed of a plurality of plates in order to simplify the configuration of the valves 3, 5. In addition, the valve plate 10 is covered by an additional plate 13 which consists of a non-magnetic material and is connected to the valve plate 10 via a circumferential welding seam. The additional plate 13 furthermore has a raised portion 23 which serves to guide a spring 15 used for restoring the position of the armature 9. The other end of the spring 15, which is embodied as a helical compression spring in the present embodiment, projects into a receiving space 17 of the armature 9, which space is designed as a circumferential groove on the side of the armature 9 facing the coil assembly 8. An additional receiving space 16 of the armature 9 serves to receive the working diaphragm 2 when the armature 9 moves in the direction of the coil assembly 8. The cup-shaped embodiment of the receiving space 16 supports the working diaphragm 2 during the build-up in pressure. In so doing, the service life of the working diaphragm 2 is increased. The operative connection of the working diaphragm 2 to the armature 9 takes place in the present example via a screw connection. The working diaphragm 2 comprises a damping cone in the form of a material thickening, by means of which the movement of the armature 9 can be decelerated before said armature 9 strikes against the valve plate 10. A further limit stop 21 delimits the stroke of the armature 9 in the resetting direction. The ends of the working diaphragm 2 are fixed by means of a ring 25 on the valve plate 10, said ring 25 engaging in a corresponding receiving area on the valve plate 10. The working diaphragm 2 can be tensioned by means of the ring 25.

The diaphragm pump depicted in FIG. 2 is characterized by a very small dead volume. Almost the entire volume of the working chamber 1 is displaced by the working medium 2, whereby the high level of efficiency of the pump is further increased. In addition the delivery volume can be determined with a high degree of accuracy.

Figure 4:
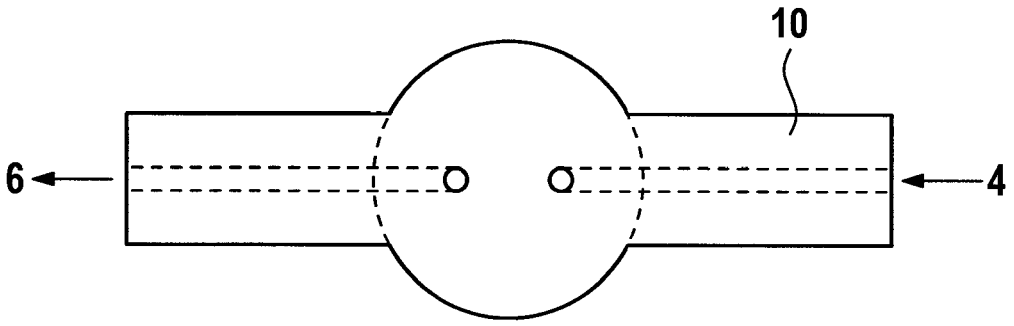
FIG. 4 shows a bottom view of a valve plate of the diaphragm pump of FIG. 2.
Figure 5A:
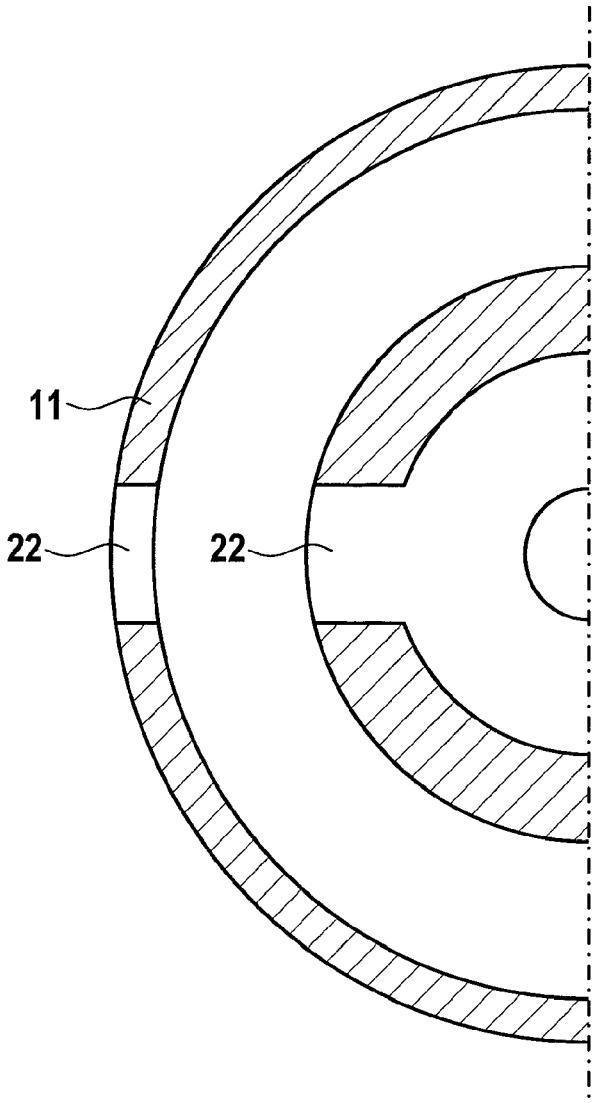
FIGS. 5*a, b* show partial sections through the housing of the diaphragm pump of FIG. 2.
Figure 5B:
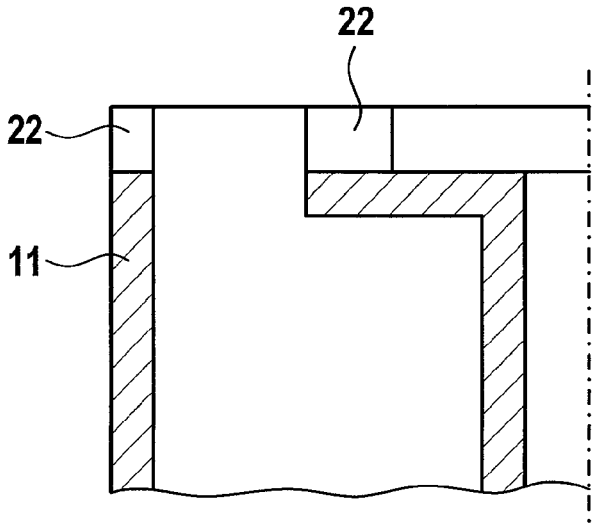

The installation space can furthermore be substantially reduced by integrating the pump elements into the electromagnet 7. A contributory factor here is that the valve plate 10, as depicted in FIG. 2, is embedded in the housing 11 of the electromagnet 7. To this end, the housing 11 comprises a recess 22 (see FIGS. 5*a* and 5*b*) which is correspondingly configured to the form of the valve plate 10 (see FIG. 4). The valve plate embedded in the housing 11 is additionally fixed in the recess 22 by the additional plate 13, which is configured as an annular disk in the present embodiment. For this purpose, the annular disk or, respectively, additional plate 13 is welded by means of a welded seam 20 to the valve plate 10 as well as to the housing 11. The annular disk can have a thickness of less than 0.2 mm.

Figure 7:
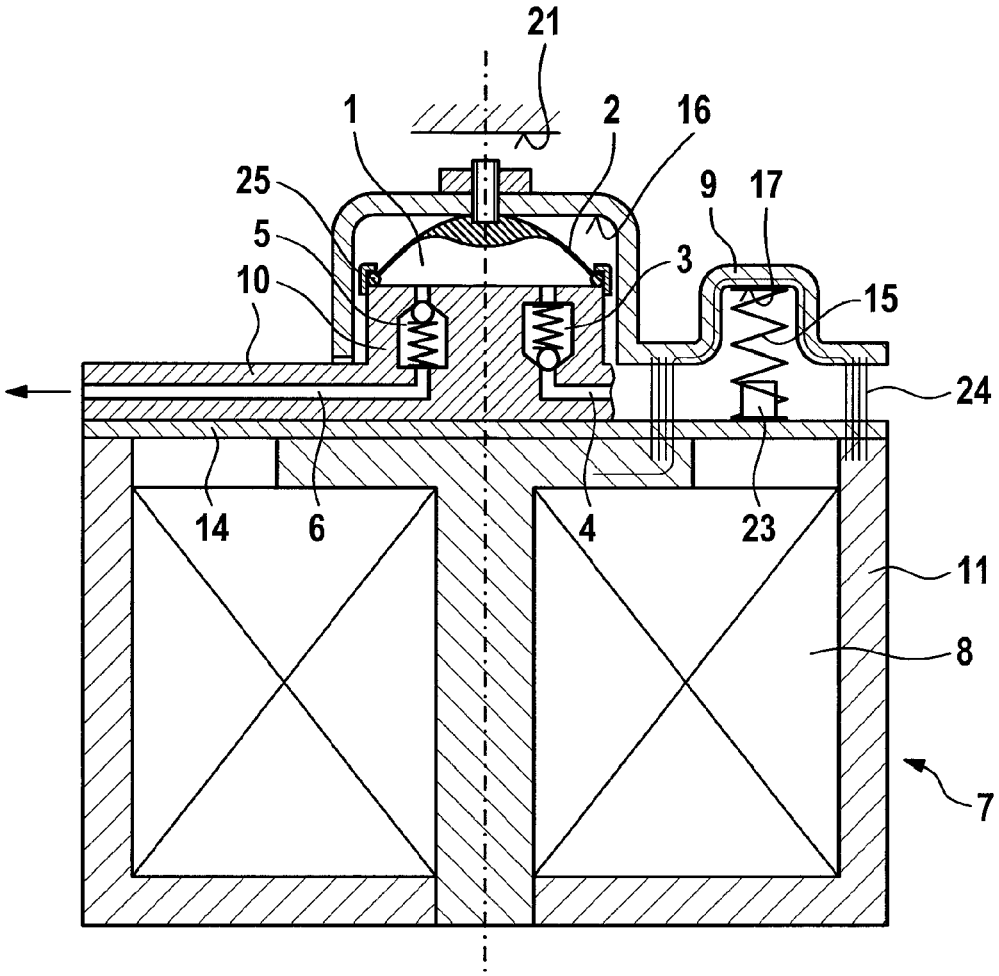
FIG. 7 shows a schematic cross-section through a further inventive diaphragm pump.
Figure 8:
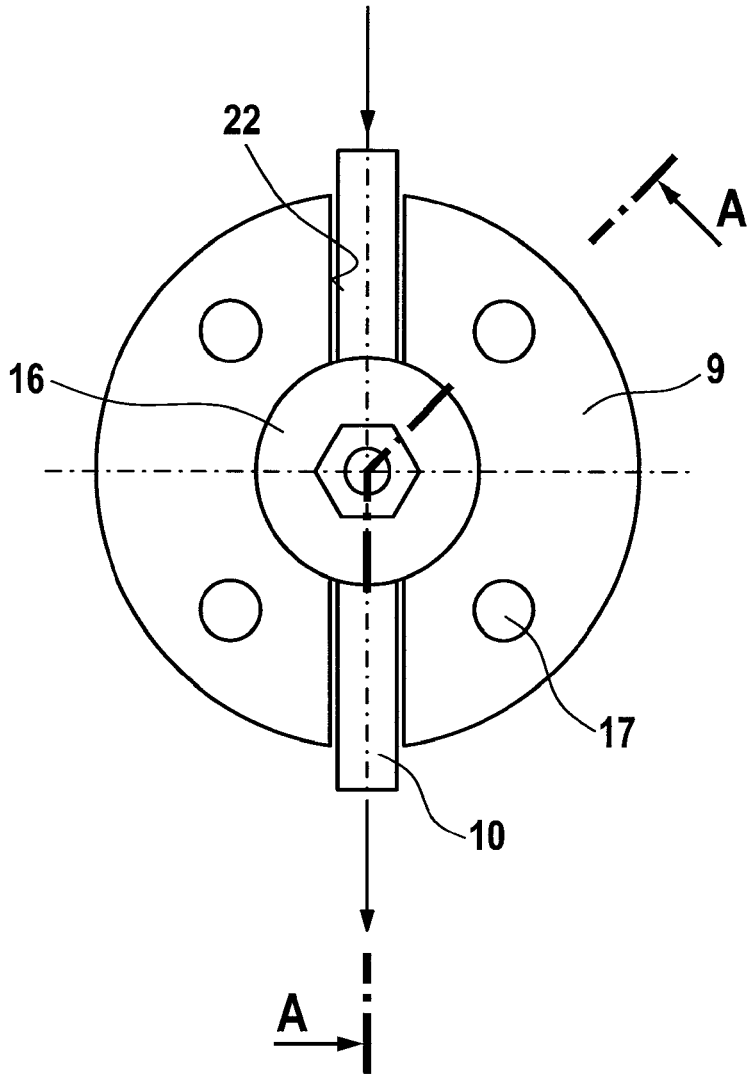
FIG. 8 shows a top view of an armature of the diaphragm pump of FIG. 7
Figure 9:
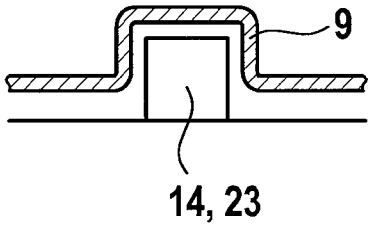
FIG. 9 shows a partial section through the armature of the diaphragm pump of FIG. 7.

An alternative embodiment of the diaphragm pump according to the invention is depicted in FIG. 7. This distinguishes itself from the embodiment of FIG. 2 by virtue of the fact that the essential pump elements, namely the working diaphragm and the valves 3, 5 are disposed within the receiving space 16 of the armature 9. The top side of the housing 11 of the electromagnet 7, which serves as a pole face, can accordingly be planarly designed, which simplifies the manufacture of the electromagnet 7. The armature 9 is embodied as a stamped/bent part in order to configure the receiving space 16 as well as further receiving spaces 17 for a plurality of return springs 15. In so doing, the manufacturing costs can be further reduced. The plate 13 can be eliminated and a plate 14 made from a non-magnetic material can instead be disposed between the valve plate 10 and the housing 11. The magnetic flux 24 across the housing 11 into the armature 9 continues to be ensured. The plate 14 has raised portions 23 in order to guide the springs 15 which are supported on the plate 14. The raised portions 23 can be integrally formed with said plate 14 (see FIG. 9) or subsequently mounted to the same (see FIG. 7). As can be seen in FIG. 8, the armature 9, aside from the receiving spaces 16, 17, comprises a recess 22 in which the valve plate 10 is embedded.

The operations of the diaphragm pumps of FIGS. 2 and 7 hardly differ. If the coil assembly 8 is supplied with current, the armature 9 moves in the direction of said coil assembly 8. The working diaphragm 2 is thereby moved into the working chamber 1, whereby the volume of the working chamber 1 is reduced. This leads to an increase in pressure in the working chamber 1 which in turn leads to the opening of the valve 5, via which the medium present in the working chamber 1 travels into the outlet 6. If the supply of current to the coil assembly has ended, the spring force of the spring or springs 15 causes the armature to be restored to the original position thereof. The same is true for the working diaphragm 2, so that a vacuum develops on account of the increase in volume of the working chamber 1, said vacuum leading to the opening of the valve 3 and thereby to the drawing in of fresh medium.

The armature 9, which is guided radially with respect to the electromagnet 7 via the working diaphragm 2 and the at least one spring 15, has two terminal stops, namely the valve plate 10 or, respectively, the additional plate 13 or 14 mounted thereon and the limit stop 21. Owing to the principles involved, the armature 9 does not experience any radial forces; thus allowing a radial guidance of the armature 9 to be omitted. The armature 9 does however experience a certain radial guidance via the at least one spring 15.

Figure 6A:
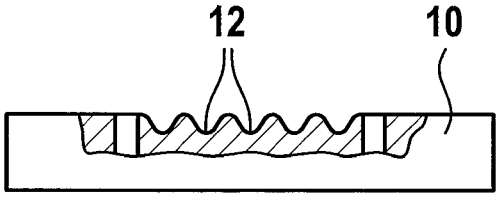
FIG. 6*a* shows a partial section through the valve plate of FIG. 4.
Figure 6B:
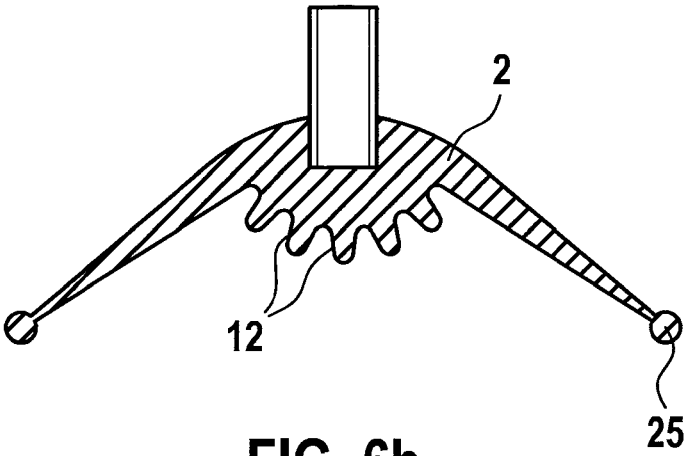
FIG. 6*b* shows a cross-section through the working diaphragm of the diaphragm pump of FIG. 2.

Both of the preferred embodiment variants described have the advantage that an undesirable noise generation is prevented or at least substantially reduced. A noisy striking of the armature 9 is, for example, prevented as a result of the working diaphragm 2 comprising a damping cone (see FIGS. 2 and 7). The working diaphragm 2 can alternatively or additionally be provided with damping grooves 12 which provide an additional damping by virtue of the medium having to be displaced from the grooves 12 prior to the armature 9 striking the housing, electromagnet or valve plate (see FIG. 6*b*). The damping grooves 12 preferably consist of the same material as the working diaphragm, wherein said diaphragm further preferably relates to an elastomer membrane. The valve plate 10 can also alternatively or additionally be equipped with damping grooves 12 (see FIG. 6*a*).

What is claimed is:

1. A diaphragm pump for delivering a fluid, comprising a working chamber (1), which is delimited by a working diaphragm (2) and which is connected via a first valve (3) to an inlet (4) and via a second valve (5) to an outlet (6), and an electromagnet (7) which comprises a coil assembly (8) and an armature (9) which interacts with the coil assembly (8) and is operatively connected to the working diaphragm (2), wherein the first and second valves (3, 5) are disposed in a valve plate (10) which is arranged between the coil assembly (8) and the armature (9), and wherein the first and second valves (3, 5) are axially disposed between the coil assembly (8) and the armature (9).

2. The diaphragm pump according to claim 1, wherein the valve plate (10) is at least partially embedded in a housing (11) of the electromagnet (7) or in the armature (9).

3. The diaphragm pump according to claim 1, wherein at least one of the valve plate (10) and the working diaphragm (2) comprise damping grooves (12), which are arranged circumferentially.

4. The diaphragm pump according to claim 1, wherein the valve plate (10) is covered at least partially on one side or both sides by at least one additional plate (13, 14), wherein the additional plate (13, 14) consists of a non-magnetic material and/or is welded to the housing (11) of the electromagnet (7).

5. The diaphragm pump according to claim 4, wherein the at least one additional plate (13) is disposed axially between the coil assembly (8) and the armature (9).

6. The diaphragm pump according to claim 1, wherein the armature (9) is guided in a radial direction by at least one spring (15) which serves to restore the armature (9) to its original position after a current supply to the coil assembly (8) has ended.

7. The diaphragm pump according to claim 6, wherein the at least one spring (15) for restoring the armature (9) to its original position is a progressive spring.

8. The diaphragm pump according to claim 1, wherein the armature (9) embodies at least one cup-shaped receiving space (16, 17) for the at least partial accommodation of at least one of the valve plate (10) and a spring (15).

9. The diaphragm pump according to claim 1, wherein the armature (9) is a stamped/bent part.

10. The diaphragm pump according to claim 1, wherein the electromagnet (7) comprises at least one of a DC magnet and a coil (8), the coil (8) having two inside diameters.

11. The diaphragm pump according to claim 1, wherein the valve plate is covered at least partially on one side or both sides by at least one additional plate which consists of a non-magnetic material.

12. The diaphragm pump according to claim 11, wherein the valve plate is covered at least partially on one side or both sides by at least one additional plate which is welded to the housing (11) of the electromagnet (7).

13. The diaphragm pump according to claim 1, wherein the valve plate is covered at least partially on one side or both sides by at least one additional plate which is welded to the housing (11) of the electromagnet (7).

14. The diaphragm pump according to claim 1, wherein the entire valve plate (10) is arranged between the coil assembly (8) and the armature (9).

15. The diaphragm pump according to claim 1, wherein the armature (9) moves along an axis, wherein the working diaphragm (2) has a concave inner surface facing the working chamber (1), wherein the working diaphragm (2) has a central region along the axis that is contacted and moved by the armature (9), and radially exterior regions that are coupled to the valve plate (10), wherein the radially exterior regions are disposed axially closer to the coil assembly (8) than the central region is disposed axially to the coil assembly (8).

16. The diaphragm pump according to claim 1, wherein the working chamber (1) is bordered only by the working diaphragm (2) and the valve plate (10).

17. The diaphragm pump according to claim 1, further comprising a spring (15) coupled to both an additional plate (13) and the armature (9), wherein the spring (15) is disposed axially between the additional plate (13) and the armature (9).

18. An exhaust-gas aftertreatment system comprising a diaphragm pump according to claim 1 for delivering an exhaust-gas aftertreatment medium.

19. The diaphragm pump according to claim 18, wherein at least one of the valve plate and the working diaphragm comprise damping grooves, which are arranged circumferentially.

20. A diaphragm pump for delivering a fluid, comprising a working chamber (1), which is delimited by a working diaphragm (2) and which is connected via a first valve (3) to an inlet (4) and via a second valve (5) to an outlet (6), and an electromagnet (7) which comprises a coil assembly (8) and an armature (9) which interacts with the coil assembly (8) and is operatively connected to the working diaphragm (2), wherein the first and second valves (3, 5) are disposed in a valve plate (10), wherein the first and second valves (3, 5) are axially disposed between the coil assembly (8) and the armature (9), and wherein the armature (9) is disposed entirely outside of the working chamber (1).

* * * * *